United States Patent [19]

Gaggini et al.

[11] 4,044,684

[45] Aug. 30, 1977

[54] AEROSOL PROJECTILE FOR LACHRYMATING MATERIAL

[75] Inventors: Guido John Gaggini, Cowansville; Eugene Lawrence Gould, Kittanning, both of Pa.

[73] Assignee: Federal Laboratories, Inc., Saltsburg, Pa.

[21] Appl. No.: 704,788

[22] Filed: July 13, 1976

[51] Int. Cl.[2] ..... F42B 13/46

[52] U.S. Cl. ..... 102/90

[58] Field of Search ..... 102/66, 90, 65; 244/3.29

[56] References Cited

U.S. PATENT DOCUMENTS

| | | | |
|---|---|---|---|
| 2,271,280 | 1/1942 | Weinert | 102/90 |
| 3,404,630 | 10/1968 | Grandy | 102/66 |
| 3,831,520 | 8/1974 | Bowen et al. | 102/66 |

*Primary Examiner*—Charles T. Jordan

*Attorney, Agent, or Firm*—Albert F. Kronman

[57] ABSTRACT

A projectile for dispensing an aerosol of lachrymating irritant material in which the aerosol material is ejected through a nozzle only after firing from a gun or weapon launcher and has imported within the target area. Safety means is provided to prevent premature discharge of the aerosol.

6 Claims, 6 Drawing Figures

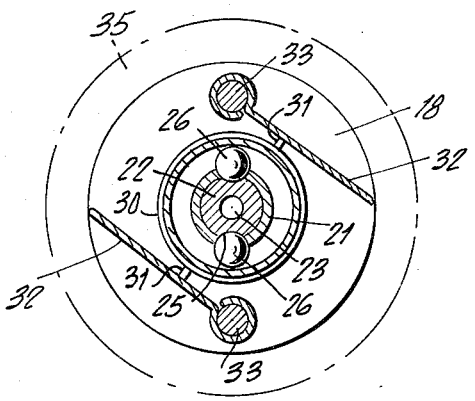
FIG. 3
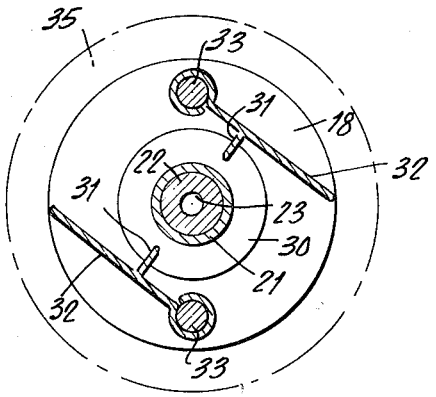
FIG. 4
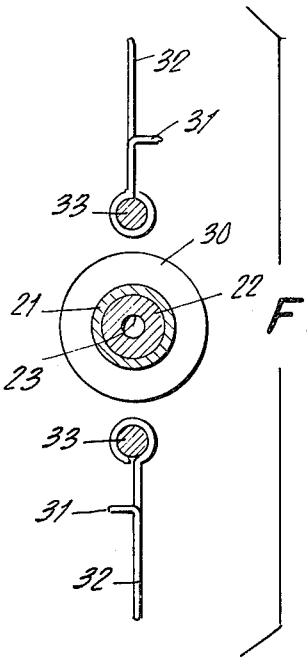
FIG. 5
FIG. 6
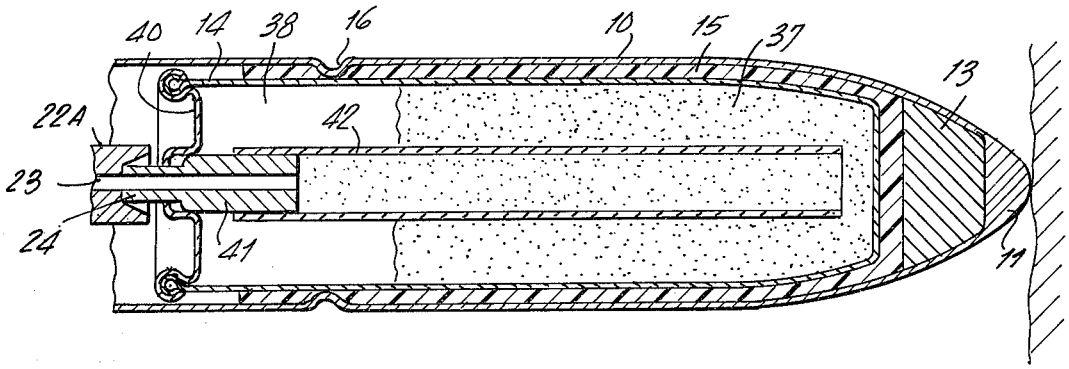

AEROSOL PROJECTILE FOR LACHRYMATING MATERIAL

BACKGROUND OF THE INVENTION

Projectile having tear gas or dust as one of their components have been used for some time. Such devices, however, have employed explosive charges or thermal means to disperse the irritants. These dispersing means can cause severe injury to personnel and property.

In the present invention the projectile is armed upon firing from a gun and is activated upon impact to disperse tear gas. However, there is no detonation, no fragmentation, and no high temperature generation so that there is no fire hazard and no high speed flying fragments are produced. If accidentally dropped while being loaded, the projectile will not discharge its contents.

One of the features of the present invention is the mechanical safety means which "arms" the projectile only when it is fired from a gun or mortar.

Another feature of the invention is the manner in which the tear gas formulation is ejected from the container by an inert, cold, propellant gas.

SUMMARY

The invention comprises a projectile for conveying an aerosol container of lachrymating material from a launching position to a dispensing location where the material within the container is released. The projectile includes a container under pressure having a valve plus a valve stem at one end of the container for releasing the propellant and lachrymating material when the valve stem is depressed. An activating plunger is mounted in alignment. with the valve stem for opening the valve. The plunger is held in a safety position by a ball lock until the projectile is fired. An axial tube surrounds the plunger and is secured to the projectile case. The tube retains the ball in its locked position. An inertia member is slidably mounted on the tube and is formed with a circular flange for normally holding the ball in its locking position. The inertia member is held in its retaining position by a pair of spring urged fins including tabs which engage the inertia member. The plunger is formed with an activating surface at one of its ends for engaging the valve stem when the plunger is released.

Additional details of the invention will be disclosed in the following description, taken in connection with the accompanying drawings:

BRIEF DESCRIPTION OF THE FIGURES

FIG. 3 is a cross sectional view of the projectile shown in FIG. 1 and is taken along line 3—3 of that figure.

FIG. 4 is another cross sectional view of the projectile, taken along lien 4—4 of FIG. 1.

FIG. 5 is a cross sectional view of the unfolded fins, and is taken along line 5—5 of FIG. 2.

FIG. 6 is a fragmentary cross sectional view of the container and is taken along a median line of FIG. 2.

DESCRIPTION OF THE PREFERRED EMBODIMENT

Figure 1:
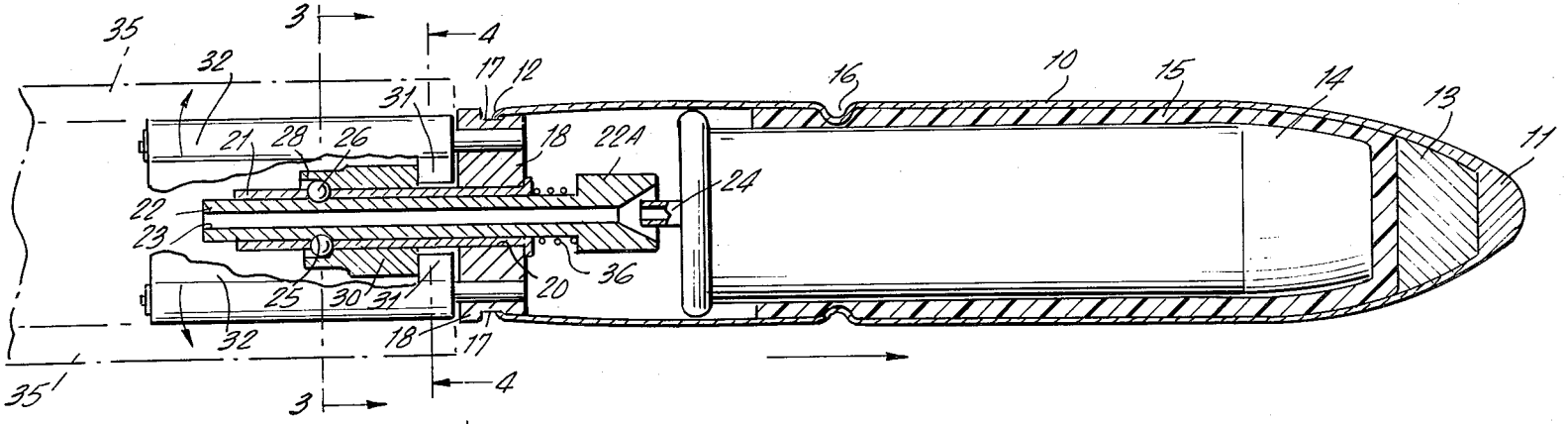
FIG. 1 is a cross sectional view of a projectile made in accordance with the present invention showing the fins folded within a launching gun barrel.

Referring to the figures, the projectile includes an enclosing shell 10 of steel, aluminum, plastic, etc. formed in a generally cylindrical shape with a blunt nose space filled with a small lead insert 13 to assist in holding the shell in alignment during its trajectory. Inside the steel shell 10 is a container 14, shown in greater detail in FIG. 6. The container 14 is held securely in place by a plastic liner 15 which surrounds the container 14 and is held in place by a plurality of crimps as a centering means 16 in the shell 10.

Figure 2:
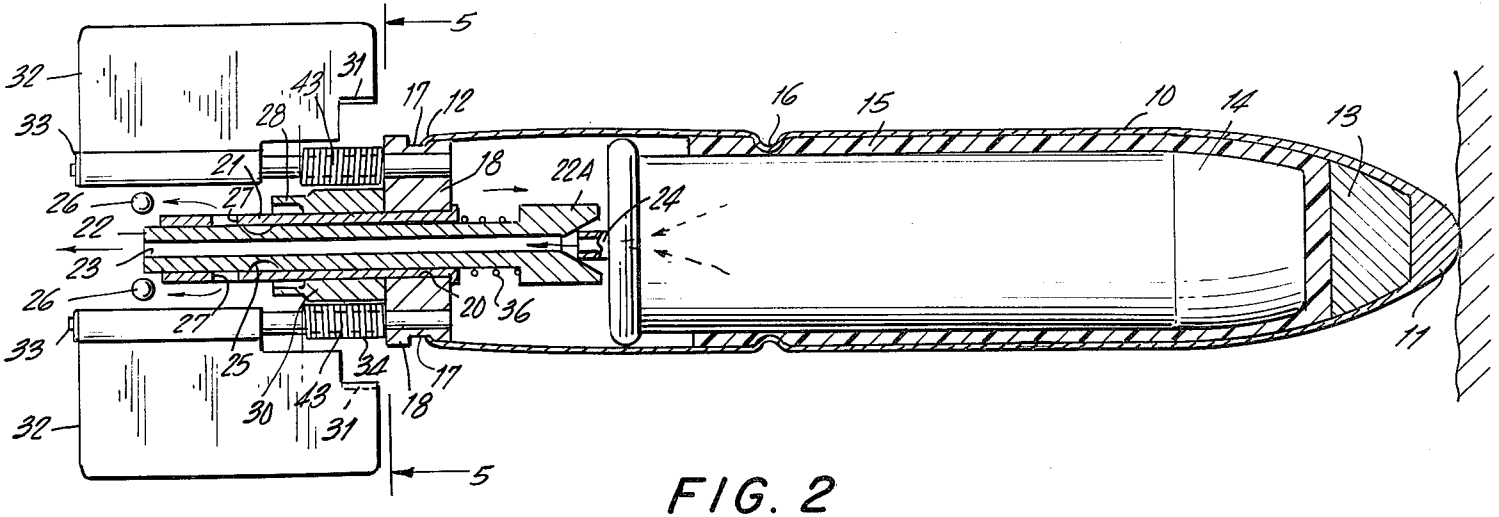
FIG. 2 is a cross sectional view similar to FIG. 1 after firing from the gun and upon impact.

The edge crimp 12 is forced into a circular slot 17 in a thick washter 18 which acts as a base member for the shell 10. An axial hole 20 is formed in the washer 18 and within it is secured a flanged axial tube 21. The tube 21 carries a slidable actuating plunger 22 therein. The plunger 22 is provided with an enlarged inner head 22A and an axial bore 23 through which the contents of the container 14 may escape upon impact. The inner end of head 22A is formed in a reentrant conical shape in order to make proper contact with the valve stem 24. The main shaft of the plunger 22 is formed with two recesses 25 as shown in FIGS. 1, 2 and 3. Balls 26 fit into these recesses 25 when the valve actuating mechanism is locked in its normal condition for shipment, handling and loading. The locking mechanism also includes two holes 27 (FIG. 2) for receiving the balls 26 and thereby holding the tube 21 and the plunger 22 in an inactive position as shown in FIG. 1.

The balls 26 are retained in their locked position by a ring 28, which is an integral part of an inertia member 30, which is slidably mounted on the outside surface of tube 21. The inertia member 30, in turn is held in its ball retaining position by two tabs 31, connected to fins 32. The fins 32 are swingably mounted on posts 33, extending rearwardly from and secured to washer 18. A spring 34 is positioned around each post 33 and urges the fins 32 to move to the extended or open position shown in FIGS. 2 and 5 when the projectile is fired and the fins clear the confines of a launching barrel 35 (see FIGS. 1, 3 and 4.). The plunger 22 is urged toward the valve stem 24 by a helical spring 36. This spring is operable only after the balls 26 have been ejected from the ball lock upon impact. The plunger then makes contact with the valve stem 24 to open the valve and permit the contents to escape.

Details of the gas container 14 are shown in FIG. 6 where the container holds a lachrymating material such as tear gas or dust 37 and inert pressurized propellant 38 such as Freon, nitrogen, $CO_2$, etc. The dispensing end of the container 14 is closed by a partition 40 having a crimped peripheral edge where it is secured to the rear edge of the container 14. The center of partition 40 holds a dispensing valve 41, the details of which are not shown since this type of valve may take several forms, all of which are well-known in the art and form no part of the present invention. Valve 41 is held open by the spring loaded plunger head 22A following impact. The usual dip tube 42 is secured to the valve 41.

The operation of the projectile will be apparent by the above description. In greater detail, the projectile is shipped and handled with the fins folded inwardly and secured in that position by the base or cartridge assembly (not shown). When the projectile is to be launched, the tape is removed and the fins, still in their folded positions are slipped into the barrel 35 of a gun, mortar or other launcher. When ready, the projectile components are arranged as shown in FIG. 1. When launched by an explosive charge in the cartridge, or the like, the projectile leaves the base (or cartridge) and the fins are extended by springs 43, tabs 31 are removed from the inertial member 30 and the inertia member is free to move on tube 21. However, the force of the launch and other inertia and frictional forces keep the member 30 in its locked position. When the projectile comes to a stop on impact the change in inertia causes member 30 to move forward removing the ring 28 from the balls 26. The balls are released and the sudden stop propells plunger 22 and its head 22A toward the valve stem 24, opening the valve 41, and permitting the active gas to escape through stem 24 and bore 23. The aerosol release position is shown in FIG. 2. From FIG. 2 it is evident that the contents of the aerosol container 14 is provided with many parts of escape from bore 23 since posts 33 protect the rear end of the bore 23 and keep the end free from being blocked, regardless of the final position of the projectile.

Having thus fully described the invention, what is claimed as new and desired to be secured by Letters Patent of the United States is:

1. A projectile for conveying and dispersing lachrymating material in an aerosol form comprising:

a. a hollow enclosing shell having an impacting portion at one end and a base at the other end thereof.

b. a container having a quantity of lachrymating material under pressure within the shell;

c. valve means for the container disposed adjacent the base of the shell for dispensing the said lachrymating material;

d. a plurality of stabilizing fins swingably carried by and extending outwardly of the base.

e. a washer shaped member carried in the base of the shell said washer shaped member having a central opening therein;

f. an actuating plunger slidably carried within the washer opening in alignment with the valve means;

g. locking means engagable with the actuating plunger until shell impacting;

h. an inertial member, slidably disposed about the plunger and overlying the locking means and;

i. tabs carried by the fins to hold the locking means in engagement with the plunger and inertia member until launching of the shell.

2. A projectile according to claim 1 in which the impacting portion of the shell is weighted and the lachrymating material is a tear gas and an aerosol forming propellant.

3. A projectile according to claim 1 in which the stabilizing fins are provided with springs yieldably urging them into an open, operative position.

4. A projectile according to claim 1 in which the actuating plunger is axially bored to dispense the lachrymating material therethrough and spring loaded in the direction of the container valve.

5. A projectile according to claim 1 in which the locking means comprises a plurality of balls, ball receiving recesses in the actuating plunger and a ring on the inertial member overlying the locking balls in the locked position.

6. A projectile according to claim 1 in which an axial tube is disposed between the actuating plunger and the inertial member said tube having ball receiving openings therein whereby the locking balls are released therethrough upon projectile impact.

* * * * *